US009515377B2

(12) United States Patent
Zhang et al.

(10) Patent No.: US 9,515,377 B2
(45) Date of Patent: Dec. 6, 2016

(54) ANTENNA APPARATUS, ANTENNA DEVICE AND SIGNAL TRANSMITTING APPARATUS

(71) Applicant: Huawei Technologies Co., Ltd., Shenzhen, Guangdong (CN)

(72) Inventors: Long Zhang, Shenzhen (CN); Qingxia Li, Shenzhen (CN); Rong Rong, Shenzhen (CN); Yuan Zhou, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 487 days.

(21) Appl. No.: 13/949,058

(22) Filed: Jul. 23, 2013

(65) Prior Publication Data

US 2013/0335293 A1 Dec. 19, 2013

Related U.S. Application Data

(63) Continuation of application No. PCT/CN2012/075922, filed on May 23, 2012.

(30) Foreign Application Priority Data

Dec. 16, 2011 (CN) ..... 2011 1 0424366
Feb. 15, 2012 (CN) ..... 2012 1 0034075

(51) Int. Cl.
*H01Q 3/24* (2006.01)
*H01Q 1/50* (2006.01)
(Continued)

(52) U.S. Cl.
CPC ..... *H01Q 1/50* (2013.01); *H01Q 3/242* (2013.01); *H01Q 9/16* (2013.01); *H01Q 19/30* (2013.01); *H01Q 21/205* (2013.01)

(58) Field of Classification Search
CPC ..... H01Q 21/28; H01Q 3/242
See application file for complete search history.

(56) References Cited

U.S. PATENT DOCUMENTS 5,896,108 A 4/1999 Shafai
5,970,398 A 10/1999 Tuttle
(Continued)

FOREIGN PATENT DOCUMENTS

CA 2494982 A1 * 10/2003 ..... G06F 1/1616
CN 1600016 A 3/2005
(Continued)

OTHER PUBLICATIONS

English translation of Wang An-guo et al., "Design of Broadband Quasi-Yagi Antenna with Pattern Reconfigurability," School of Electronic Information Engineering, Tianjin University, Tianjin 300072, China, Oct. 2011.*
(Continued)

*Primary Examiner* — Graham Smith
(74) *Attorney, Agent, or Firm* — Leydig, Voit & Mayer, Ltd.

(57) ABSTRACT

Embodiments of the present invention provide an antenna apparatus. The antenna apparatus includes multiple antennas, a switching unit, a grounding layer, connecting lines and a dielectric substrate. The antennas are configured to transmit and receive electromagnetic waves. The connecting lines are configured to connect the switching unit and the antennas. The switching unit is configured to selectively feed signals to the antennas through the connecting lines. The grounding layer serves as a reference of zero potential, and by setting the shape or size of the grounding layer and the distance from the grounding layer to the antennas, the grounding layer is further configured to restrain a transmitting direction of the electromagnetic waves transmitted by the antennas. The dielectric substrate is configured to allow the grounding layer to be printed thereon, and the dielectric substrate is further configured to allow the antennas, the switching unit and the connecting lines.

13 Claims, 5 Drawing Sheets

(51) Int. Cl.

| | |
|---|---|
| ***H01Q 9/16*** | (2006.01) |
| ***H01Q 19/30*** | (2006.01) |
| ***H01Q 21/20*** | (2006.01) |

(56) References Cited

U.S. PATENT DOCUMENTS

| | | | |
|---|---|---|---|
| 6,559,810 | B2 | 5/2003 | McCorkle |
| 2004/0125029 | A1 | 7/2004 | Maoz et al. |
| 2006/0109067 | A1 | 5/2006 | Shtrom |
| 2009/0066602 | A1 | 3/2009 | Lindberg et al. |

FOREIGN PATENT DOCUMENTS

| | | | |
|---|---|---|---|
| CN | 1934750 | A | 3/2007 |
| CN | 1965442 | A | 5/2007 |
| CN | 1985404 | A | 6/2007 |
| CN | 101859927 | A | 10/2010 |
| CN | 201838722 | U | 5/2011 |
| CN | 102437423 | A | 5/2012 |

OTHER PUBLICATIONS

Wang An-guo et al. ; "Design of Broadband Quasi-Yagi Antenna with Pattern Reconfigurability"; School of Electronic Information Engineering, Tianjin University, Tianjin 300072, China; Oct. 2011; total 6 pages.

* cited by examiner (4a)

(4b)

(4c)

ANTENNA APPARATUS, ANTENNA DEVICE AND SIGNAL TRANSMITTING APPARATUS

CROSS-REFERENCE TO RELATED APPLICATIONS

This application is a continuation of International Application No. PCT/CN2012/075922, filed on May 23, 2012, which claims priority to Chinese Patent Application No. 201210034075.2, filed on Feb. 15, 2012, both of which are hereby incorporated by reference in their entireties.

FIELD OF THE INVENTION

Embodiments of the present invention relate to the field of communications, and in particular, to an antenna apparatus and an antenna device.

BACKGROUND OF THE INVENTION

In the recent decade, more and more data needs to be transmitted as the rapid development of the wireless local area network and mobile communications. It is an important and urgent task to satisfy the growing number of users and a higher transmission rate and to guarantee a higher communication quality with limited spectrum resources. In the late 90s of the last century, Bell Laboratory took the lead in applying the concept of a MIMO (Multiple Input Multiple Output) system in a mobile communication system, and proved theoretically and experimentally that MIMO was able to greatly increase the capacity and quality of the mobile communication system, which drew great attention from scholars. The MIMO technology developed rapidly in a short few years, and has become the core technology of a new generation of mobile communication systems (3G, LTE) and a new generation of wireless local area networks 802.11n (Wi-Fi) and 802.16 wireless metropolitan area networks WiMax.

Multiple antennas are placed at both the transmitting end and the receiving end of a MIMO system, and a diversity technique and a multiplexing technique are rationally used so that the capacity of the wireless communication system is increased and the bit error rate of the system is reduced simultaneously. Especially in an environment having rich multipath components, the MIMO system shows huge potential in increasing the capacity of the system. The MIMO system also uses a beamforming (Beamforming) technique to focus energy in a specific direction (or some specific directions) so that the main lobe points to the signal direction, and meanwhile nulling is performed on interference signals, thereby realizing a wider coverage and having inhibitory effects on the interference signals.

In the MIMO system, multiple antennas are used at both the receiving end and the transmitting end, so the design of the antennas in the MIMO system is a key point and a difficult point in the overall system design. In order to construct a MIMO system with high efficiency, the design style of an antenna array is usually adopted at the transmitting end of the system, and meanwhile the beamforming technique is adopted, so as to form an intelligent antenna array suitable for the MIMO system. Compared with a conventional omnidirectional antenna array, such intelligent antenna array enables the MIMO system to obtain a higher capacity, a lower bit error rate, a wider coverage and stronger interference inhibition performance.

An existing intelligent antenna apparatus includes an intelligent antenna array and a beam switching network. The antenna array and the beam switching network are usually printed on one dielectric substrate, so as to facilitate installation and reduce costs. The main factors that are considered in the existing intelligent antenna design are how to make the intelligent antenna array cover the entire space, and how to enhance signals in the direction of users and to inhibit interference signals simultaneously. In order to inhibit the interference signals, a directional pattern of the antenna is usually made into a unilateral beam, and in order to obtain an antenna directional pattern having orientation characteristics, a reflector is added to the antenna. However, a certain distance shall be kept between the beam switching network and the antenna, so that the addition of the reflector further increases the size of the system. The size of the antenna apparatus and the performance of the antenna apparatus contradict each other, and it is difficult to improve the performance of the antenna apparatus without increasing the size of the antenna apparatus.

SUMMARY OF THE INVENTION

Embodiments of the present invention provide an antenna apparatus and including an antenna device, so as to improve the performance of the antenna apparatus without increasing the size of the antenna apparatus.

An embodiment of the present invention provides an antenna apparatus, where the antenna apparatus includes multiple antennas, a switching unit, a grounding layer, connecting lines and a dielectric substrate. The antennas are configured to transmit and receive electromagnetic waves. The connecting lines are configured to connect the switching unit and the antennas. The switching unit is configured to selectively feed signals to the antennas through the connecting lines. The grounding layer serves as a reference of zero potential, and by setting the shape or size of the grounding layer and the distance from the grounding layer to the antennas, the grounding layer is further configured to restrain a transmitting direction of the electromagnetic waves transmitted by the antennas. The dielectric substrate is configured to allow the grounding layer to be printed thereon, and the dielectric substrate is further configured to allow the antennas, the switching unit and the connecting lines to be printed or installed thereon.

An embodiment of the present invention provides an antenna device, where the device includes multiple antennas, a grounding layer, connecting lines and a dielectric substrate. The antennas are configured to transmit and receive electromagnetic waves. The connecting lines feed signals to the antennas. The grounding layer serves as a reference of zero potential, and by setting the shape or size of the grounding layer and the distance from the grounding layer to the antennas, the grounding layer is further configured to restrain a transmitting direction of the electromagnetic waves transmitted by the antennas. The dielectric substrate is configured to allow the grounding layer to be printed thereon, and the dielectric substrate is further configured to allow the antennas and the connecting lines to be printed or installed thereon.

In the embodiments of the present invention, a grounding layer is designed so that the grounding layer restrains the transmitting direction of the electromagnetic waves transmitted by the antennas, thereby solving the problem of enhancing radiation energy of the antennas in a certain direction and reducing the volume of the entire antenna array simultaneously. The embodiments of the present invention realize an intelligent antenna apparatus with desirable performance in a limited space.

BRIEF DESCRIPTION OF THE DRAWINGS

To make the technical solutions of the embodiments of the present invention or the prior art clearer, the accompanying drawings used in the description of the embodiments are briefly described hereunder. Evidently, the accompanying drawings illustrate some exemplary embodiments of the present invention and persons of ordinary skill in the art may obtain other drawings based on these drawings without creative efforts.

DETAILED DESCRIPTION OF THE EMBODIMENTS

To make the objectives, technical solutions, and advantages of the embodiments of the present invention clearer, the technical solutions provided by the embodiments of the present invention are hereinafter described clearly and completely with reference to the accompanying drawings. Evidently, the described embodiments are only some embodiments of the present invention, rather than all embodiments of the present invention. Based on the embodiments herein, persons of ordinary skill in the art can derive other embodiments without creative efforts and such other embodiments all fall within the protection scope of the present invention.

Figure 1:
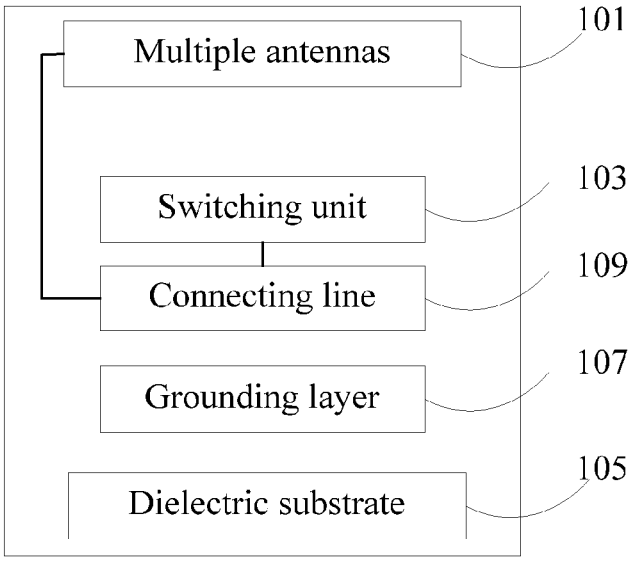
FIG. 1 is a schematic structural diagram of an embodiment of an antenna apparatus of the present invention.

An embodiment of the present invention provides an antenna apparatus. As shown in FIG. 1, FIG. 1 provides a schematic structural diagram of an embodiment of the antenna apparatus of the present invention. The apparatus includes multiple antennas 101, a switching unit 103, a grounding layer 107, connecting lines 109 and a dielectric substrate 105. The antennas are configured to transmit and receive electromagnetic waves. The connecting lines are configured to connect the switching unit and the antennas. The switching unit is configured to selectively feed signals to the antennas through the connecting lines. The grounding layer serves as a reference of zero potential, and by setting the shape or size of the grounding layer and the distance from the grounding layer to the antennas, the grounding layer is further configured to restrain a transmitting direction of the electromagnetic waves transmitted by the antennas. The dielectric substrate is configured to allow the grounding layer to be printed thereon, and the dielectric substrate is further configured to allow the antennas, the switching unit and the connecting lines to be printed or installed thereon. The zero potential is the zero potential of an apparatus circuit.

In an embodiment of the present invention, the switching unit 103, the grounding layer 107, the connecting lines 109 and the dielectric substrate 105 constitute a beam switching network.

In an embodiment of the present invention, the multiple antennas 101 include at least two antennas.

The switching unit 103 is configured to switch and feed signals to the antennas, and selectively couple radio frequency signals to one or more antenna units.

In another embodiment of the present invention, the switching unit 103 is further configured to make the radio frequency signals fed to the multiple antennas generate phase differences.

In an embodiment of the present invention, the switching unit is constructed by using a PIN diode, a single-pole single-throw radio frequency switch, or a single-pole multiple-throw radio frequency switch, or a switch matrix or various combinations thereof. In an embodiment of constructing the switching unit by using a PIN diode, parallel control signals are connected to the grounding layer through three PIN diodes. If the control signals give an anode pin of a PIN diode 1 a high level and give an anode pin of a PIN diode 2 and an anode pin of a PIN diode 3 a low level, and meanwhile cathodes of the PIN diodes 1, 2 and 3 are all at a low level, the PIN diode 1 is in an on state, and the PIN diode 2 and the PIN diode 3 are in an off state, so that the signals can reach the corresponding antenna 1 through the PIN diode 1 and be transmitted through the antenna. When the control signals change to give the anode pin of the PIN diode 2 a high level and give the anode pins of the PIN diode 1 and the PIN diode 3 a low level, the PIN diode 2 is in an on state, and the PIN diode 1 and the PIN diode 3 are in an off state, so that the signals can reach the corresponding antenna 2 through the PIN diode 2 and be transmitted through the antenna, thereby achieving the purpose of beam switching. The ways to realize beam switching are not limited to this one, and are not listed here one by one.

In another embodiment of the present invention, the switching unit is constructed by using a single-pole single-throw radio frequency switch, or a single-pole multiple-throw radio frequency switch, or a switch matrix or various combinations thereof.

The grounding layer 107 is configured to restrain the transmitting direction of the electromagnetic waves transmitted by the antennas. In another embodiment of the present invention, the grounding layer may be further configured to restrain bandwidth of the antennas. The grounding layer is configured to reversely refract the electromagnetic waves transmitted by the antennas when the electromagnetic waves transmitted by the antennas reach a metallic reflector, so as to enhance the radiation of the antennas towards one direction and reduce the radiation of the antennas towards another direction. A connecting line 109 is a two-wire transmission structure, such as a micro-strip line structure or a parallel-strip line structure. The shape or size of the grounding layer and the distance from the grounding layer to the antennas are set according to indexes of the antennas. In another embodiment of the present invention, the shape or size of the grounding layer and the distance from the grounding layer to the antennas are set according to directional patterns of the antennas or an operating bandwidth of the antennas.

In still another embodiment of the present invention, the shape of the grounding layer is an N-gon, and values of side lengths of the N-gon and the distance from each side to a feeding point of the antennas are set according to the directional patterns of the antennas or the operating bandwidth of the antennas, where N is a natural number greater than 2.

Figure 2:
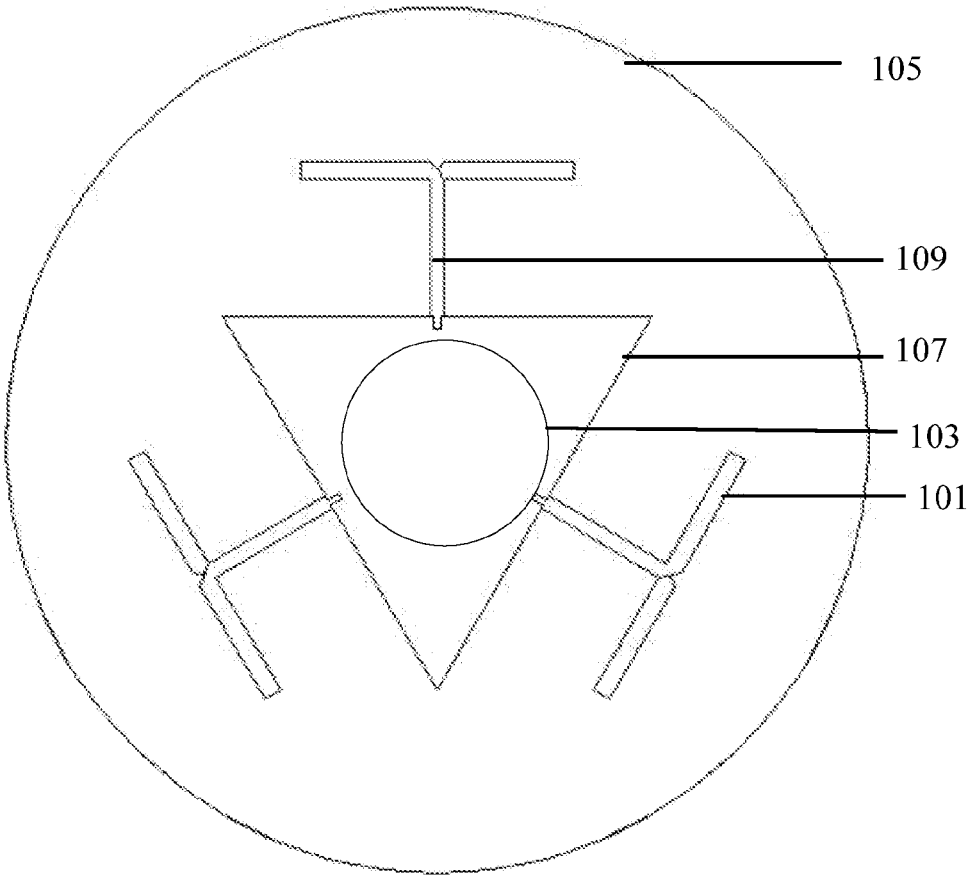
FIG. 2 is a schematic structural diagram of another embodiment of the antenna apparatus of the present invention.

In another embodiment of the present invention, as shown in FIG. 2, FIG. 2 provides a schematic structural diagram of another embodiment of the antenna apparatus of the present invention. The antenna apparatus includes multiple antennas 101, a switching unit 103, a grounding layer 107, connecting lines 109 and a dielectric substrate 105. The multiple antennas 101 include three antennas. The shape of the grounding layer 107 is an equilateral triangle, and a side length of the equilateral triangle and the distance between the antennas and the grounding layer are set according to indexes of the antennas. The indexes of the antennas at least include directional patterns of the antennas or operating bandwidth of the antennas. By adjusting the distance between the antennas and the grounding layer and the side length of the equilateral triangle, the grounding layer may serve as a reflector of the three groups of antennas so that the three groups of antennas generate the same unilateral beams. In an embodiment of the present invention, the distance between the antennas and the grounding layer is at about an ¼ wavelength of an operating wavelength of the antennas. The deviation from the ¼ wavelength depends on specific circumstances, and the factors affecting the deviation include an antenna form and an array structure. The antennas are distributed around the grounding layer. The area of the grounding layer is greater than the cross-sectional area of the switching unit.

The antenna apparatus includes a layer of dielectric substrate, and the switching unit and the grounding layer are printed or installed on a side of a paper of the dielectric substrate facing inwards and a side of the paper facing outwards, respectively.

In an embodiment of the present invention, an antenna is a dipole antenna, two arms of the antenna are printed or installed on the side of the paper of the dielectric substrate facing inwards and the side of the paper facing outwards, one arm of the antenna printed or installed on the side of the paper of the dielectric substrate facing inwards is connected to the grounding layer or the switching unit and the grounding layer printed or installed on the side of the paper facing inwards through a feed line of the two-wire transmission structure printed or installed on the side of the paper of the dielectric substrate facing inwards, and one arm of the antenna printed or installed on the side of the paper of the dielectric substrate facing outwards is connected to the grounding layer or the switching unit printed or installed on the side of the paper facing outwards through a feed line of the two-wire transmission structure printed or installed on the side of the paper of the dielectric substrate facing outwards.

In an embodiment of the present invention, an antenna is a dipole antenna, two arms of the antenna are both printed or installed on the side of the paper of the dielectric substrate facing inwards or the side of the paper facing outwards, and the two arms of the antenna are connected to the switching unit and the grounding layer through a coaxial line. The two arms of the antenna are connected to the switching unit and the grounding layer through an inner core and a shielding layer of the coaxial line, respectively. The inner core of the coaxial line is connected to one arm of the antenna, the shielding layer of the coaxial line is connected to the other arm of the antenna, an inner core at the other end of the coaxial line is connected to the switching unit, and a shielding layer at the other end of the coaxial line is connected to the grounding layer.

In the existing design of an intelligent antenna array in a MIMO system, many antenna units as possible often need to be arranged in a limited space due to the restriction of the size and structure of a receiver or transmitter, and the existing design of antenna units and antenna arrays occupies a large space. Because the directional patterns formed by the three groups of antennas in the embodiment of the present invention have an angular offset from each other, angle diversities between the antennas can be realized when the entire space is covered. Because the antennas do not use any independent reflector structure, the embodiment of the present invention can reduce the size of the antenna array and the entire system to the maximum extent in favor of miniaturization of the system.

In another embodiment of the present invention, the antenna apparatus includes multiple layers of dielectric substrates, two arms of an antenna may be printed or installed on different dielectric substrates, and the switching unit and the grounding layer are printed or installed on different dielectric substrates.

Figure 3:
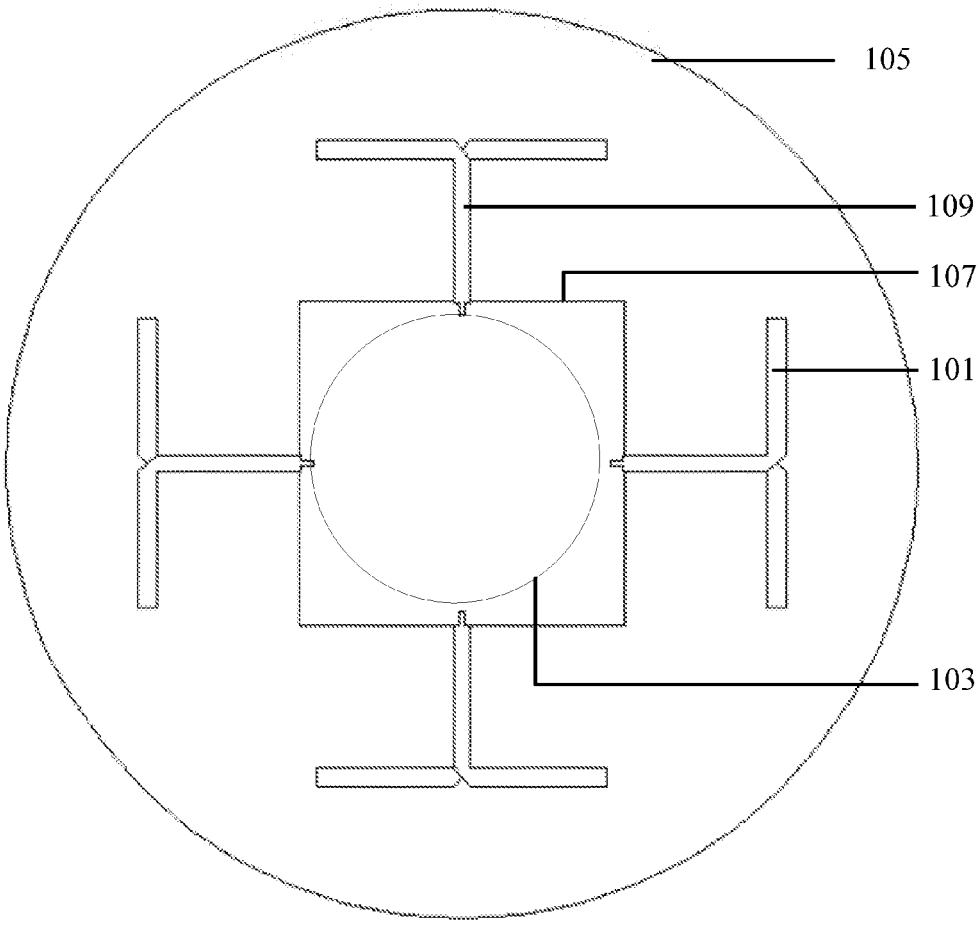
FIG. 3 is a schematic structural diagram of still another embodiment of the antenna apparatus of the present invention.

In another embodiment of the present invention, as shown in FIG. 3, FIG. 3 provides a schematic structural diagram of still another embodiment of the antenna apparatus of the present invention. The antenna apparatus includes multiple antennas 101, a switching unit 103, a grounding layer 107, connecting lines 109 and a dielectric substrate 105. The multiple antennas 101 include four antennas. The shape of the grounding layer 107 is a rectangle, and side lengths of the rectangle and the distance between the antennas and the grounding layer are affected by indexes of the antennas. The indexes of the antennas at least include directional patterns of the antennas or operating bandwidth of the antennas. By adjusting the distance between the antennas and the grounding layer and the side lengths of the rectangle, the grounding layer may serve as a reflector of the four groups of antennas so that the four groups of antennas generate the same unilateral beams. The antennas are distributed around the grounding layer. The area of the grounding layer is greater than the cross-sectional area of the switching unit.

Figure 4:
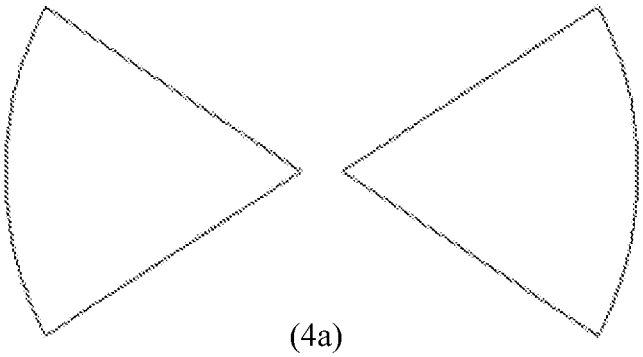
FIG. 4 is a schematic diagram of an antenna of different shapes in an embodiment of the present invention.
Figure 4:
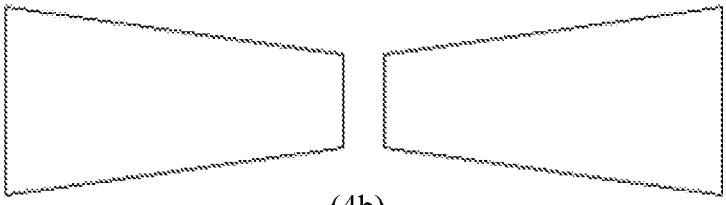
Figure 4:
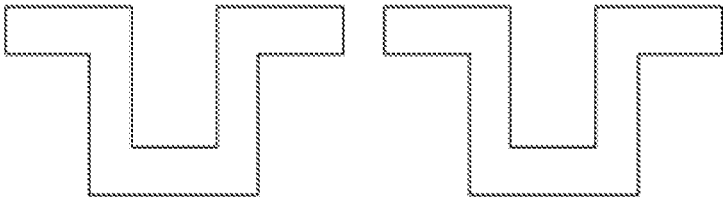

In a specific embodiment of the present invention, an antenna 101 is a dipole antenna, and the antenna includes two arms in the shape of two rectangles of the same length, two sectors of the same shape, two trapezoids of the same shape and two folds of the same shape. As shown in FIG. 4, FIG. 4 provides a schematic diagram of an antenna of different shapes in an embodiment of the present invention. FIG. 4*a* is a schematic diagram of a sector-shaped antenna in the embodiment of the present invention, FIG. 4*b* is a schematic diagram of a trapezoid-shaped antenna in the embodiment of the present invention, and FIG. 4*c* is a schematic diagram of a fold-shaped antenna in the embodiment of the present invention.

Figure 5:
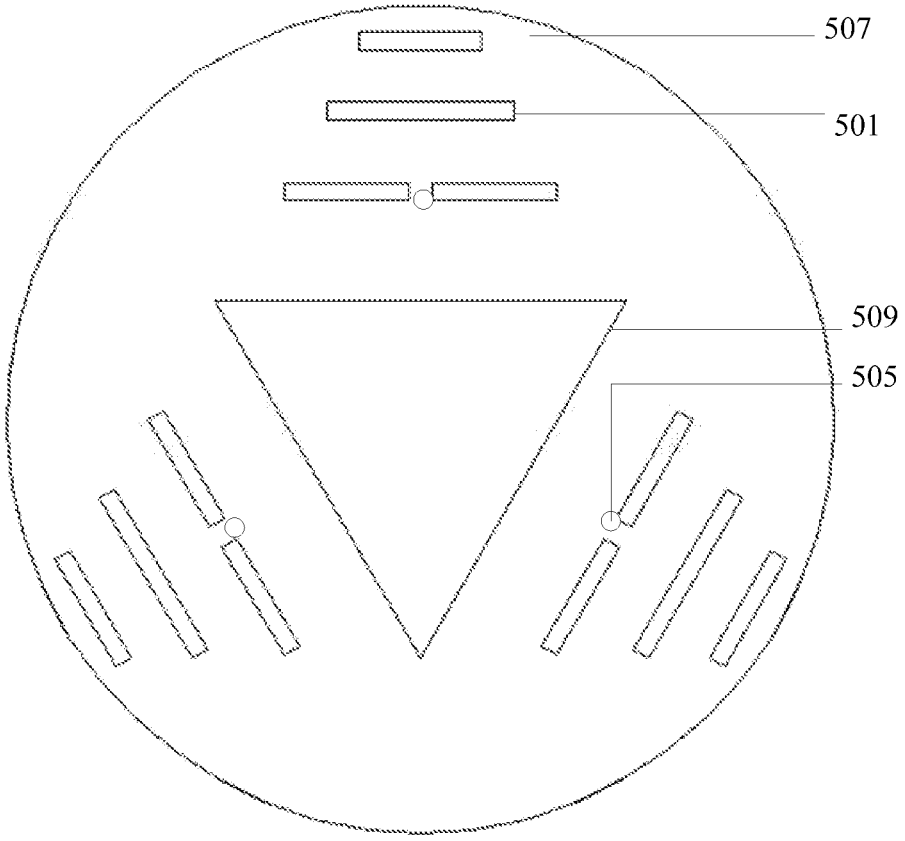
FIG. 5 is a schematic structural diagram of still another embodiment of the antenna apparatus of the present invention.

In another embodiment of the present invention, the antenna is a Yagi antenna. As shown in FIG. 5, FIG. 5 provides a schematic diagram of another embodiment of the antenna apparatus of the present invention. The system includes multiple antennas 501, a switching unit 509, a grounding layer, connecting lines 505 and a dielectric substrate 507. The antennas are configured to transmit and receive electromagnetic waves. The switching unit is configured to selectively feed signals to the antennas through the connecting lines. The grounding layer serves as a reference of zero potential, and the grounding layer is further configured to restrain a transmitting direction of the electromagnetic waves transmitted by the antennas. The connecting lines are configured to feed the signals to the antennas through the switching unit. The connecting lines are coaxial lines.

The Yagi antenna is printed or installed on a side of the paper of the dielectric substrate facing inwards or a side of the paper facing outwards, and the antenna is connected to the switching unit through a coaxial line.

The connecting lines 109 may be connecting lines of any shape.

In a specific embodiment of the present invention, the material of the dielectric substrate 105 is common FR4 boards or Rogers series boards or the like. The FR4 boards are a type of material specifications (relative dielectric constant (50 Hz): ≤5.5, relative dielectric constant (1 MHz): ≤5.5, dielectric loss factor (50 Hz): ≤0.04, dielectric loss factor (1 MHz): ≤0.04, where the relative dielectric constant is a physical parameter indicating dielectric properties or polarization properties of a dielectric material, and the dielectric loss factor is data indicating the dielectric loss). Rogers is a company abroad, which is famous in the industry for generating many high-quality printed dielectric substrate (PCB) materials. A variety of boards are generated by Rogers, and especially high frequency materials thereof have desirable characteristics. Because the shape of the dipole arm is changed from the rectangle to such shapes as the sector and the trapezoid which are more beneficial for radiation of electromagnetic waves by the antenna, the sector-shaped and trapezoid-shaped antennas may broaden the frequency band response of the antennas to some extent. The fold-shaped antenna may shorten the axial length of the antenna, and reduce the size of the grounding layer of the circuit, so as to further reduce the size of the entire system.

Figure 6:
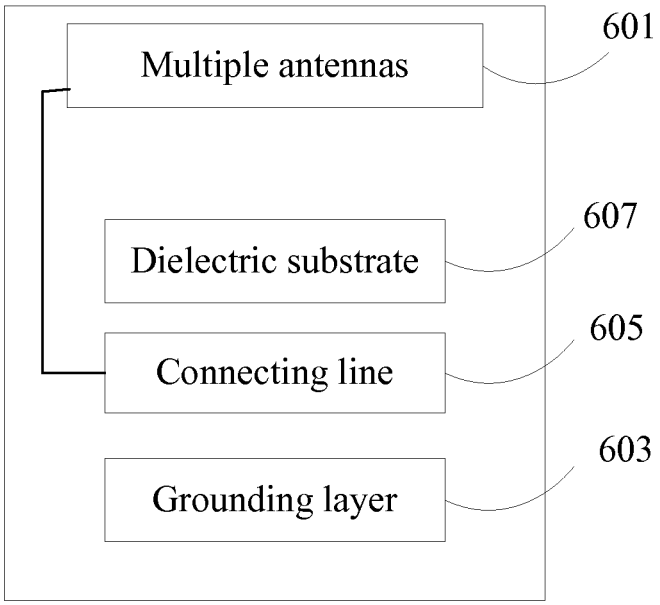
FIG. 6 is a schematic structural diagram of an embodiment of an antenna device of the present invention.

An embodiment of the present invention provides an antenna device. As shown in FIG. 6, FIG. 6 provides a schematic diagram of an embodiment of the antenna device of the present invention. The device includes multiple antennas 601, a grounding layer 603, connecting lines 605 and a dielectric substrate 607. The antennas are configured to transmit and receive electromagnetic waves. The connecting lines feed signals to the antennas. The grounding layer serves as a reference of zero potential, and by setting the shape or size of the grounding layer and the distance from the grounding layer to the antennas, the grounding layer is further configured to restrain a transmitting direction of the electromagnetic waves transmitted by the antennas. The dielectric substrate is configured to allow the grounding layer to be printed thereon, and the dielectric substrate is further configured to allow the antennas and the connecting lines to be printed or installed thereon.

In an embodiment of the present invention, the multiple antennas include at least two antennas.

In an embodiment of the present invention, the grounding layer may be further configured to restrain bandwidth of the antennas.

In an embodiment of the present invention, the shape or size of the grounding layer and the distance from the grounding layer to the antennas are set according to indexes of the antennas.

In an embodiment of the present invention, the shape or size of the grounding layer and the distance from the grounding layer to the antennas are set according to directional patterns of the antennas or operating bandwidth of the antennas. The shape of the grounding layer includes a polygon and an irregular shape.

Figure 7:
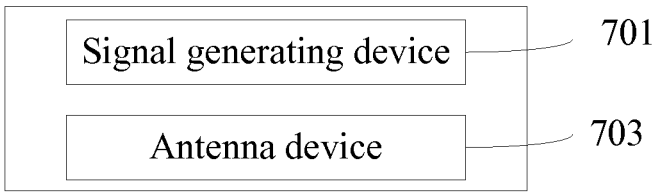
FIG. 7 is a schematic structural diagram of an embodiment of a signal transmitting apparatus of the present invention.

An embodiment of the present invention provides a signal transmitting apparatus including an antenna apparatus. As shown in FIG. 7, FIG. 7 provides a structural diagram of the embodiment of the present invention. The signal transmitting apparatus includes the antenna apparatus 703 according to any one of the above embodiments and a signal generating apparatus 701. The signal generating apparatus is configured to generate signals for the antenna apparatus.

It should be understood by persons skilled in the art that the accompanying drawings are merely schematic diagrams of an exemplary embodiment, and modules or processes in the accompanying drawings are not necessarily required in implementing the present invention.

Persons skilled in the art may understand that the modules in the apparatuses provided in the embodiments may be arranged in the apparatuses in a distributed manner according to the description of the embodiments, or may be arranged in one or more apparatuses which are different from those described in the embodiments. The modules according to the above embodiments may be combined into one module, or split into multiple submodules.

Finally, it should be noted that the embodiments of the present invention are intended for describing the technical solutions of the present invention other than limiting the present invention. Although the present invention is described in detail with reference to the foregoing embodiments, persons of ordinary skill in the art should understand that they can still make modifications to the technical solutions described in the foregoing embodiments or make equivalent substitutions to some technical features thereof, without departing from the spirit and scope of the technical solution of the embodiments of the present invention.

What is claimed is:

1. An antenna apparatus, comprising:

three antennas, configured to transmit and receive electromagnetic waves;

a switching unit;

a grounding layer, wherein the grounding layer is shaped as an equilateral triangle with a side length of the equilateral triangle being set according to indices of the three antennas, with each of the three antennas being disposed around the grounding layer on a respective side of the equilateral triangle, and wherein distance between the three antennas and the grounding layer is about ¼ of an operating wavelength of the three antennas;

connecting lines, configured to connect the switching unit and the three antennas; and a dielectric substrate on which the grounding layer, the three antennas, the switching unit, and the connecting lines are printed;

wherein the switching unit is configured to selectively feed signals to the three antennas through the connecting lines;

wherein the grounding layer is configured to provide a reference of zero potential;

wherein, based on a shape or size of the grounding layer and a distance from the grounding layer to the three antennas, the grounding layer is further configured to serve as a reflector for the three antennas, restraining a transmitting direction of the electromagnetic waves transmitted by the three antennas and causing each of the three antennas to generate the same unilateral beams.

2. The antenna apparatus according to claim 1, wherein the grounding layer is further configured to restrain bandwidth of the three antennas.

3. The antenna apparatus according to claim 1, wherein side lengths of the equilateral triangle and a distance from each side to a feeding point of the three antennas are based on the directional patterns of the three antennas or the operating bandwidth of the three antennas.

4. The antenna apparatus according to claim 3, wherein the switching unit is printed on a first side of the dielectric substrate and the grounding layer is printed on a second side of the dielectric substrate.

5. The antenna apparatus according to claim 4, wherein the three antennas comprise a dipole antenna;

wherein one arm of the dipole antenna is printed on the first side of the dielectric substrate and is connected to the switching unit printed on the first side of the dielectric substrate through a two-wire transmission line on the first side of the dielectric substrate; and wherein another arm of the dipole antenna is printed on the second side of the dielectric substrate and is connected to the grounding layer printed on the second side of the dielectric substrate through a two-wire transmission line on the second side of the dielectric substrate.

6. The antenna apparatus according to claim 4, wherein the three antennas comprise a dipole antenna;

wherein two arms of the dipole antenna are both printed on the first side of the dielectric substrate or the second side of the dielectric substrate; and wherein the two arms of the dipole antenna are connected to the switching unit and the grounding layer through a coaxial line.

7. The antenna apparatus according to claim 4, wherein the three antennas comprise a Yagi antenna;

wherein the Yagi antenna is printed on the first side of the dielectric substrate or the second side of the dielectric substrate; and wherein the Yagi antenna is connected to the switching unit and the grounding layer through a coaxial line.

8. The antenna apparatus according to claim 1, wherein the antenna apparatus comprises multiple layers of dielectric substrates;

wherein two arms of the three antennas are printed on different dielectric substrates of the multiple layers of dielectric substrates; and wherein the switching unit and the grounding layer are printed on different dielectric substrates of the multiple layers of dielectric substrates.

9. The antenna apparatus according to claim 8, wherein the switching unit further comprises:

a PIN diode;

a single-pole single-throw radio frequency switch;

a single-pole multiple-throw radio frequency switch; and/or a switch matrix.

10. The antenna apparatus according to claim 8, wherein the switching unit is further configured to provide radio frequency signals to the three antennas with phase differences.

11. An antenna device, comprising:

three antennas configured to transmit and receive electromagnetic waves;

a grounding layer configured to provide a reference of zero potential, wherein the grounding layer is shaped as an equilateral triangle with a side length of the equilateral triangle being set according to indices of the three antennas, with each of the three antennas being disposed around the grounding layer on a respective side of the equilateral triangle, and wherein distance between the three antennas and the grounding layer is about ¼ of an operating wavelength of the three antennas;

connecting lines configured to feed signals to the three antennas; and a dielectric substrate on which the grounding layer, the three antennas, and the connecting lines are printed;

wherein, based on a shape or size of the grounding layer and a distance from the grounding layer to the three antennas, the grounding layer is further configured to serve as a reflector for the three antennas, restraining a transmitting direction of the electromagnetic waves transmitted by the three antennas and causing each of the three antennas to generate the same unilateral beams.

12. The antenna device according to claim 11, wherein the grounding layer is further configured to restrain bandwidth of the three antennas.

13. The antenna device according to claim 12, wherein the shape or size of the grounding layer and the distance from the grounding layer to the three antennas are based on the indices of the three antennas.

* * * * *